US010655627B2

(12) United States Patent
Sarri

(10) Patent No.: US 10,655,627 B2
(45) Date of Patent: May 19, 2020

(54) MULTI-SECTION CENTRIFUGAL COMPRESSOR

(71) Applicant: Nuovo Pignone Srl, Florence (IT)

(72) Inventor: Franco Sarri, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 461 days.

(21) Appl. No.: 15/104,443

(22) PCT Filed: Dec. 16, 2014

(86) PCT No.: PCT/EP2014/077893
§ 371 (c)(1),
(2) Date: Jun. 14, 2016

(87) PCT Pub. No.: WO2015/091435
PCT Pub. Date: Jun. 25, 2015

(65) Prior Publication Data

US 2016/0312786 A1 Oct. 27, 2016

(30) Foreign Application Priority Data

Dec. 18, 2013 (IT) ..... CO2013A0069

(51) Int. Cl.
*F04D 17/12* (2006.01)
*F04D 29/42* (2006.01)
(Continued)

(52) U.S. Cl.
CPC ..... *F04D 17/12* (2013.01); *F04D 29/046* (2013.01); *F04D 29/284* (2013.01); *F04D 29/4206* (2013.01)

(58) Field of Classification Search
CPC ..... F04D 29/424
See application file for complete search history.

(56) References Cited

U.S. PATENT DOCUMENTS 3,229,642 A * 1/1966 Lobanoff ..... F04D 1/063 415/100
4,493,611 A * 1/1985 Funakoshi ..... F01D 9/026 415/199.1
(Continued)

FOREIGN PATENT DOCUMENTS

CN 2409357 Y 12/2000
CN 2575343 Y 9/2003
(Continued)

OTHER PUBLICATIONS

Machine Translation and First Office Action and Search issued in connection with corresponding CN Application No. 201480069368.1 dated Feb. 2, 2018.
(Continued)

*Primary Examiner* — David E Sosnowski
*Assistant Examiner* — Juan G Flores
(74) *Attorney, Agent, or Firm* — Baker Hughes Patent Organization

(57) ABSTRACT

A multi-section centrifugal compressor includes at least a first and a second section; each section has an inlet duct and a discharge duct, the discharge duct of the first section is placed in fluid communication with the inlet duct of the second section, the second section is configured to compress a fluid compressed by the first section; the discharge duct of the second section is adjacent to the inlet duct of the first section.

19 Claims, 3 Drawing Sheets

(51) Int. Cl.
*F04D 29/046* (2006.01)
*F04D 29/28* (2006.01)

(56) References Cited

U.S. PATENT DOCUMENTS

| | | | | |
|---|---|---|---|---|
| 5,669,756 | A | 9/1997 | Brasz et al. | |
| 6,402,461 | B1 | 6/2002 | Tebby | |
| 6,464,469 | B1 * | 10/2002 | Grob | F04D 17/12 417/251 |
| 2004/0179961 | A1 | 9/2004 | Pugnet et al. | |

FOREIGN PATENT DOCUMENTS

| | | | |
|---|---|---|---|
| CN | 1756908 | A | 4/2006 |
| CN | 101133253 | A | 2/2008 |
| CN | 101163889 | A | 4/2008 |
| DE | 888298 | C | 8/1953 |
| EP | 0990798 | A1 | 4/2000 |
| JP | 2001-041191 | A | 2/2001 |
| JP | 2010-031777 | A | 2/2010 |
| JP | 2011-074888 | A | 4/2011 |
| SU | 702763 | A1 | 1/1983 |
| SU | 435692 | A1 | 7/1984 |
| WO | 20130182492 | A1 | 12/2013 |

OTHER PUBLICATIONS

Unofficial English Translation of Italy Office Action issued in connection with corresponding IT Application No. CO2013A000069 dated Aug. 26, 2014.

A PCT Search Report and Written Opinion issued in connection with corresponding PCT Application No. PCT/EP2014/077893 dated Apr. 2, 2015.

Office Action and Search Report issued in connection with corresponding RU Application No. 2016122899 dated Jul. 11, 2018.

Machine translation and Notification of reasons for refusal issued in connection with corresponding JP Application No. 2016-540029 dated Oct. 30, 2018.

Second Office Action and Search issued in connection with corresponding CN Application No. 201480069368.1 dated Dec. 5, 2018 (English Translation not available).

* cited by examiner

MULTI-SECTION CENTRIFUGAL COMPRESSOR

BACKGROUND

Embodiments of the present invention relate to a multi-section centrifugal compressor. Such compressors are used to process a working fluid in the gas or vapor state. For example, such compressors can be used to compress carbon dioxide.

A multi-section compressor may have a first and a second section. The sections operate serially, with the second section processing the output of the first section.

Both sections rotate on a common axis and each one has a plurality of impellers, each having a plurality of blades. The impeller of each section are arranged serially. Therefore, the working fluid is compressed by each impeller in a sequence, from a starting pressure to a final pressure.

Each section also has a central and a peripheral zone. Indeed, each section has an inlet duct and a discharge duct that are positioned in the peripheral zone. The discharge duct of the first section is generally placed in fluid communication with the inlet duct of the second section. In other words, the second section compresses the working fluid after it has been processed by the first section.

Additionally, the compressor has a first and second discharge scroll, which gather the working fluid from the last impeller of the first and second section respectively in order to convey it to a discharge nozzle. Due to rotordynamic constraints, in order to maintain the rotor bearing span as short as possible, one or both discharge scrolls are placed circumferentially outside the return channels u-bend of the above first and second section diaphragms bundles.

Typically, the first and second sections are configured either in a "back-to-back" or in an "in-line" configuration. In the "back-to-back" arrangement the discharge scrolls of the first and second sections are located side by side in the middle of the compressor body. In the "in-line" arrangement the discharge scroll of the first section, still located in the middle of the compressor, is adjacent to the inlet of the second section. Also, the second phase discharge is placed on the opposite side of the first section inlet. However, whenever a rotor bearing span reduction is needed to achieve an acceptable compressor rotordynamic behavior, the first section discharge scroll is located outside the return channel u-bends in both the "back-to-back" and in the "in-line" arrangement. Since the discharge scroll size is imposed by aerodynamic performance requirements, the consequence is an increased diameter of the outer casing of the compressor, which in turn has a negative impact on the whole compressor weight, cost and manageability.

BRIEF DESCRIPTION

A first embodiment of the invention is a multi-section centrifugal compressor having at least a first and a second section. Each section includes a respective n impeller with a plurality of blades. Each section also has axis of rotation. Additionally, each section has a central and a peripheral zone. Each section has an inlet duct and a discharge duct positioned in the peripheral zone. The discharge duct of the first section is placed in fluid communication with the inlet duct of the second section, so that the second section is configured to compress the fluid after it has been compressed by the first section. Furthermore, the discharge duct of the first section is positioned at an end of the compressor. The discharge duct of the second section is adjacent to the inlet duct of the first section.

This embodiment allows the first discharge scroll to be placed in an axial extremity of the compressor. In turn, this leads to a significant reduction of the diameter of the external casing, without increasing the bearing span.

BRIEF DESCRIPTION OF THE DRAWINGS

Further details and specific embodiments will refer to the attached drawings, in which.

DETAILED DESCRIPTION

Figure 1:
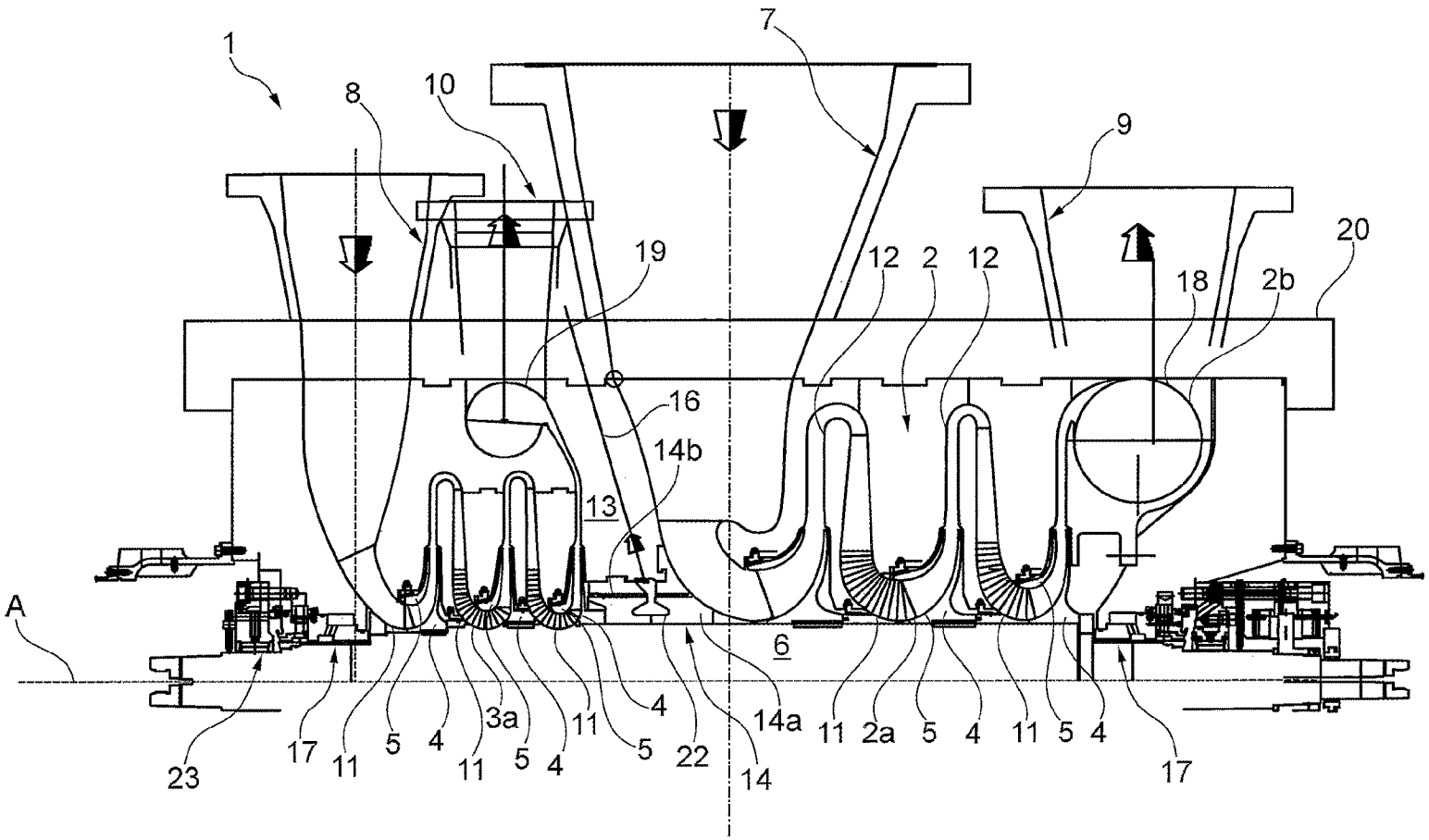
FIG. 1 is a lateral sectional view of a multi-section centrifugal compressor according to a first embodiment of the invention.

The following description of exemplary embodiments refer to the accompanying drawings. The same reference numbers in different drawings identify the same or similar elements. The following detailed description does not limit embodiments of the present invention. Instead, the scope of the embodiments of the present invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Therefore, a multi-section centrifugal compressor will be described by referring to the attached figures, in which will be indicated with the number 1. Such centrifugal compressor 1 has the function of compressing a working fluid from a starting pressure to a final pressure. The exact values of these two pressures can vary, as they depend on the specific application. However, the starting pressure can range from below atmospheric up to several hundred bar. The final pressure can be, for example, 800 bar.

In detail, the compressor 1 includes at least a first 2 and a second section 3. Each section 2, 3 has a central 2*a*, 3*a* and a peripheral zone 2*b*, 3*b*. The first section 2 has the function of compressing the working fluid from the starting pressure to an intermediate pressure. The second section 3 has the function of compressing the working fluid from the intermediate pressure to the final pressure. For example, given a starting pressure of 10 bar and a final pressure of 100 bar the intermediate pressure could be, for example, 35 bar. Also, each section 2, 3 has an inlet duct 7, 8 and a discharge duct 9, 10. These ducts 7, 8, 9, 10 are positioned in the peripheral zone 2*b*, 3*b* of the respective section. Further details about the ducts 7, 8, 9, 10 will be given in a following part of the present disclosure.

With more detail, each section 2, 3 includes at least an impeller 4 having a plurality of blades 5. According to the embodiment of invention shown in FIG. 1, each section 2, 3 has a plurality of impellers 4. The impellers 4 of each section 2, 3 are arranged serially, so that the working fluid compressed by each impeller 4 is fed to the next impeller 4 to be compressed further. Each impeller draws working fluid from an inlet 11, located near the center of the impeller 4, and discharges it to a diffuser 12. Specifically, the diffuser 12 of each impeller 4 is placed in direct fluid communication with the inlet 11 of the next impeller 4. The inlet 11 of the first impeller 4 of each section 2, 3 is placed into direct fluid communication with the respective inlet duct 7, 8. The diffuser 12 of the last impeller 4 is placed in fluid communication with the discharge duct 9, 10 of the respective section 2, 3.

Additionally, the compressor 1 also includes a first discharge scroll 18 in fluid communication with the discharge duct 9 of the first section 2. In an embodiment, the first discharge scroll 18 is arranged overhanged and peripherally with respect to the first section 2. The compressor 1 also includes a second discharge scroll 19 in fluid communication with the discharge duct 10 of the second section 3. In an embodiment, the diffuser 12 of the last impeller 4 of each section 2, 3 is placed in direct fluid communication with the respective discharge scroll 18, 19. With additional detail, the discharge scrolls 18, 19 are substantially circular channels having variable section which collect the fluid coming from the diffuser 12 of the last impeller 4 of each section 2, 3. Indeed, the discharge scrolls 18, 19 are configured to convey the working fluid to the discharge duct 9, 10 of the respective section 2, 3. According to the embodiment from FIG. 1, the second discharge scroll 19 is arranged externally with respect to the second section 3. The discharge scrolls 18, 19 are themselves known in the field of centrifugal compressors, and will therefore not be described in further detail in the present disclosure.

The compressor 1 includes a shaft 6 connected to both the first 2 and the second section 3. The shaft is connected to a motor (not shown in the drawings) which provides power to the shaft 6 and, consequently, to the impellers 4 of both the first 2 and the second section 3. In particular, the shaft 6 has a central axis "A" which is its axis of rotation.

Each section 2, 3 has an axis of rotation which, in the embodiments shown, is identified with the central axis "A" of the shaft 6. In other words, the sections 2, 3 are coaxial.

The discharge duct 9 of the first section 2 is placed in fluid communication with the inlet duct 8 of the second section 3. In other words, the second section 3 is configured to compress a fluid compressed by the first section 2. Therefore, the second section 3, from a compression process standpoint, is placed downstream with respect to the first section 2. Also, a heat exchanger 15 is placed between the discharge duct 9 of the first section 2 and the inlet duct 8 of the second section 3. Therefore, the working fluid is cooled down between the first 2 and the second section 3.

According to the embodiment shown in FIG. 1, the discharge duct 10 of the second section 3 is adjacent to the inlet duct 7 of the first section 2. With additional detail, the compressor 1 has a wall 13 at least partially defining the discharge duct 10 of the second section 3. Indeed, the wall 13 acts as an interphase diaphragm, as it is tasked to withstand the axial load due to the pressure difference between the inlet duct 7 of the first section 2 and the discharge duct 10 of the second section 3. The wall 13 is also shaped in such a way as to accommodate both the inlet duct 7 of the first section 2 and the discharge duct 10 of the second section 3, while minimizing the impact on compressor bearing span increase. The slanted shape of the wall 13 is also meant to minimize the part axial deflection while reducing its thickness.

According to an embodiment of the invention, the compressor 1 includes an interphase seal 14 between the discharge duct 10 of the second section 3 and the inlet duct 7 of the first section 2. In other words, the interphase seal 14 operates between the above defined starting and final pressures. With more detail, the interphase seal 14 is installed inside the wall 13. In an embodiment, the interphase seal 14 is a labyrinth seal, however any appropriate kind of known seal can also be employed With further detail, the last stage of the second section 3 is placed in fluid communication with the inlet duct 7 of the first section 2 through the interphase seal 14. In other words, the working fluid can flow from the last impeller 4 of the second section 3 back to the inlet duct 7 of the first section 2, driven by the pressure difference between the final pressure, that of the discharge duct 10 of the second section 3, and the starting pressure, that of the inlet duct 7 of the first section 2.

Figure 1A:
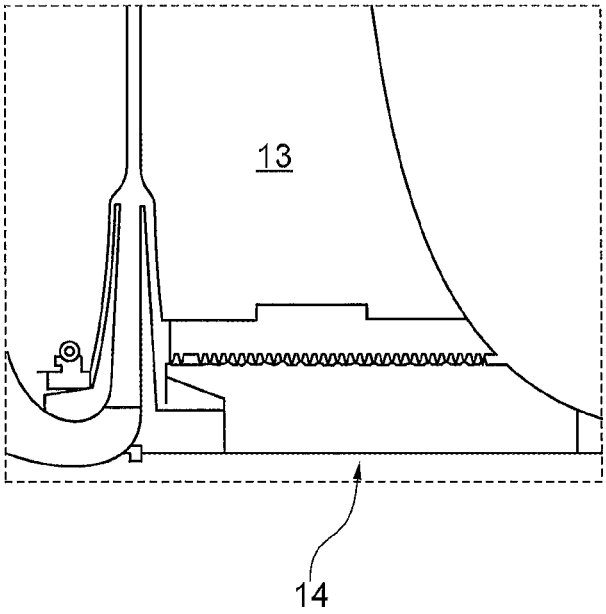
FIG. 1A is a detail of a lateral sectional view of a multi-section centrifugal compressor according to a second embodiment of the invention.
Figure 2:
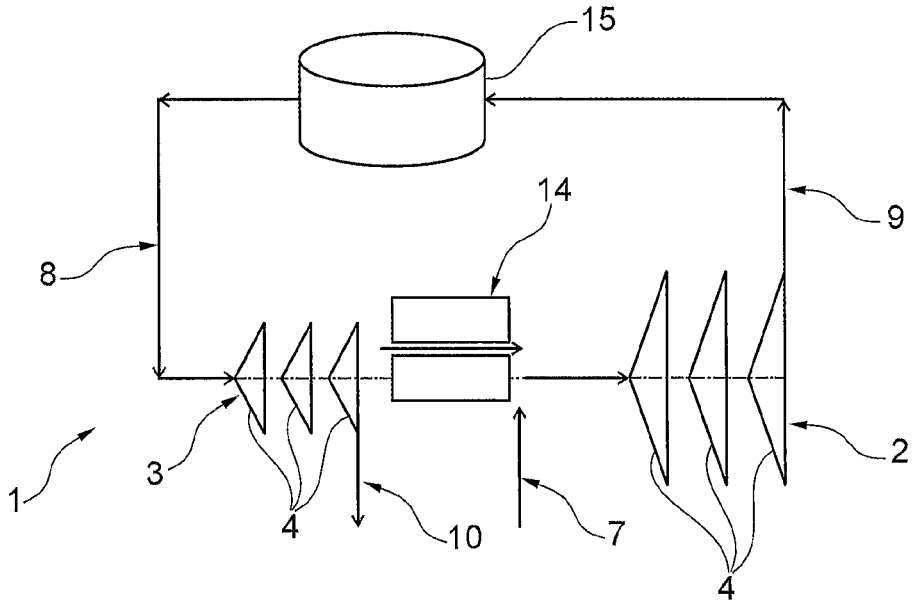
FIG. 2 is a schematic representation of the multi-section centrifugal compressor of FIG. 1.
Figure 3:
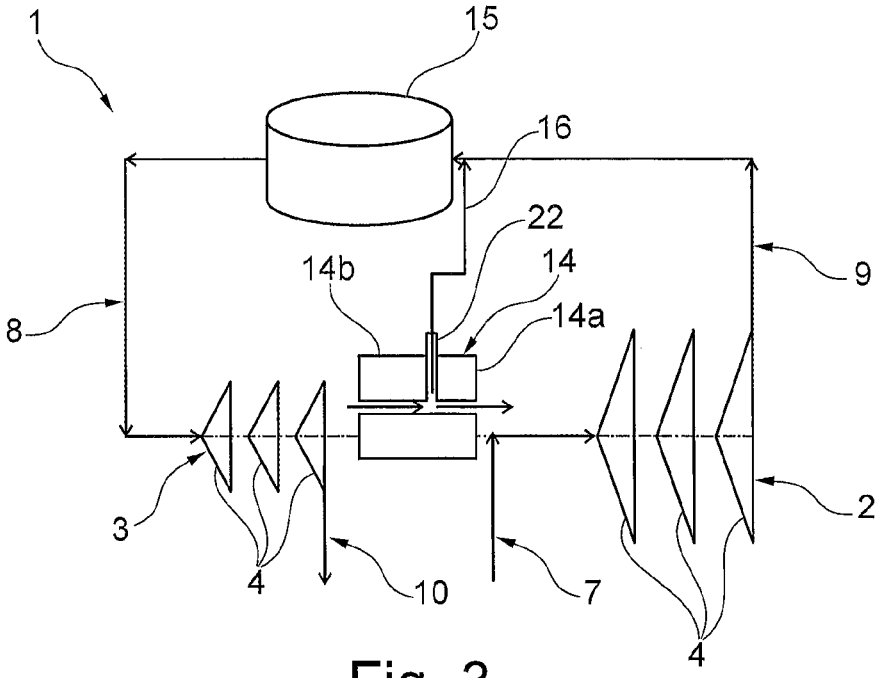
FIG. 3 is a schematic representation of the multi-section centrifugal compressor according to the embodiment of FIG. 1A.

In order to limit the efficiency loss of such arrangement, an alternative embodiment of the interphase seal 14 is shown in FIGS. 1A and 3. Specifically, the diffuser 12 of the last impeller 4 of the second section 3 is configured to be placed in fluid communication with the discharge duct 9 of the first section 2 through the interphase seal 14, as shown for example in FIG. 3. In this configuration the interphase seal 14 has a first portion 14*a* and a second portion 14*b*. The first portion 14*a* of the interphase seal 14 is adjacent to the first section 2, in particular to the inlet duct 7 of the first section 2. The second portion 14*b* of the interphase seal 14 is adjacent to the second section 3, in particular to the discharge duct 10 of the second section 3.

With additional detail, an additional seal gas line 16 is provided. In an embodiment, line 16 is placed in fluid communication with a chamber 22 between the portions 14*a*, 14*b* of the interphase seal 14 and with the discharge duct 9 of the first section 2 upstream of the heat exchanger 15.

In this way, the hot leakages coming from the higher pressure side of the interphase seal 14, that is the second portion 14*b*, is mixed with the gas coming from the discharge of the first section that is similarly hot. This mixing occurs upstream the heat exchanger 15, in order to cool down both of the leakages and the discharged gas coming from the first section 3.

The above fluid connection between the discharge duct 9 of the first section 2 and the chamber 22 allows to obtain a pressure inside the chamber 22 that is similar to the intermediate pressure, due to the larger dimensions of the discharge duct 9 with respect to the chamber 22. In this way, the pressure difference between the chamber 22 and the inlet of the first section 2 is reduced and the leakages between these two zones are consequently reduced too.

In this particular embodiment, the compressor 1 also includes two further sealing systems 17. A first further sealing system 17 is arranged between the last stage of the first section 2. Indeed, the further sealing system 17 is arranged between the central axis "A" and the first discharge scroll 18. A second further sealing system 17 is adjacent to the inlet duct 8 of the second section 3.

The compressor 1 also has a thrust bearing 23, which is placed next to the discharge duct 9 of the first section 2 according to the described embodiments of the invention.

Such thrust bearing 23 is itself known to the person skilled in the art, and will therefore not be described in further detail.

Indeed, in this embodiment the gas pressure at the two end of the compressor has approximately the same value. This condition, besides involving a compressor efficiency increase since a seal balancing line between the two compressor ends is not required, also allows further reducing the compressor bearing span as it doesn't require neither the installation of an additional shaft end labyrinth seal nor the installation of the balance piston.

The compressor 1 also has a casing 20 at least partially enveloping the first 2 and the second section 3. In an embodiment, the casing 20 contains both the first 2 and the second section 3. The casing 20 has an internal diameter substantially equal to an external diameter of the second discharge scroll 19. Indeed, due to the reciprocal arrangement of the sections 2, 3 the size of the casing 20 can be substantially reduced with respect to the prior art.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A multi-section centrifugal compressor, comprising:
a first section;
a second section, and
an inter-section wall,
wherein each of the first and second sections respectively comprises:
an impeller having an axis of rotation;
a central zone;
a peripheral zone;
an inlet duct; and
a discharge duct,
wherein the inlet duct and the discharge duct are positioned in the peripheral zone, the discharge duct of the first section is in fluid communication with the inlet duct of the second section, the second section is configured to compress a fluid compressed by the first section, the discharge duct of the second section is adjacent to the inlet duct of the first section, and the discharge duct of the first section and the inlet duct of the second section are placed on opposite ends with respect to the inter-section wall, and
wherein the inter-section wall at least partially defines the discharge duct of the second section and the inlet duct of the first section.

2. The compressor according to claim 1, wherein the discharge duct of the first section is positioned at an end of the compressor.

3. The compressor according to claim 2, further comprising a first discharge scroll in fluid communication with the discharge duct of the first section, wherein the first discharge scroll is arranged overhanged and peripherally with respect to the first section.

4. The compressor according to claim 1, further comprising an interphase seal between the discharge duct of the second section and the inlet duct of the first section, wherein the interphase seal is placed inside the inter-section wall.

5. The compressor according to claim 4, wherein each impeller is configured to draw working fluid from an inlet and to discharge the working fluid into a respective diffuser; wherein a diffuser of the second section is placed in fluid communication with an inlet of the first section through the interphase seal.

6. The compressor according to claim 5, wherein the diffuser of the second section is in fluid communication with the discharge duct of the first section through the interphase seal.

7. The compressor according to claim 6, wherein the interphase seal comprises a first portion adjacent to the first section and a second portion adjacent to the second section.

8. The compressor according to claim 7, wherein the first portion is adjacent to the inlet duct of the first section.

9. The compressor according to claim 7, wherein the second portion of the interphase seal is adjacent to the discharge duct of the second section.

10. The compressor according to claim 1, further comprising a further seal between the discharge duct of the first section and an external environment; a first discharge scroll in fluid communication with the first discharge duct; wherein the further seal is arranged between the axis of rotation and the first discharge scroll.

11. The compressor according to claim 10, further comprising a second discharge scroll in fluid communication with the second discharge duct; wherein the second discharge scroll is arranged circumferentially with respect to at least the impeller from the second section.

12. The compressor according to claim 11, further comprising a casing at least partially enveloping the first and the second section; wherein the casing has an internal diameter substantially equal to an external diameter of the second discharge scroll.

13. A multi-section centrifugal compressor, comprising:
a first section;
a second section;
an inter-section wall; and
wherein each of the first and second sections respectively comprises:
an impeller having an axis of rotation;
a central zone;
a peripheral zone;
an inlet duct; and
a discharge duct,
wherein the inlet duct and the discharge duct are positioned in the peripheral zone, the discharge duct of the first section is in fluid communication with the inlet duct of the second section, a thrust bearing positioned next to the discharge duct of the first section, the second section is configured to compress a fluid compressed by the first section, the discharge duct of the second section is adjacent to the inlet duct of the first section, and the discharge duct of the first section and the inlet duct of the second section are placed on opposite ends with respect to the inter-section wall.

14. A centrifugal compressor, comprising:
a first section comprising: a first impeller having a first axis of rotation; a first central zone; a first peripheral zone; a first inlet duct; and a first discharge duct, wherein the first inlet duct and the first discharge duct are positioned in the first peripheral zone; and
a second section comprising: a second impeller having a second axis of rotation; a second central zone; a second peripheral zone; a second inlet duct; and a second discharge duct, wherein the second inlet duct and the second discharge duct are positioned in the second peripheral zone; and a thrust bearing positioned next to the discharge duct of the first section, wherein the first discharge duct of the first section is in fluid communication with the second inlet duct of the second section, the second section is configured to compress a fluid compressed by the first section, and the second discharge duct of the second section is adjacent to the first inlet duct of the first section.

15. The compressor according to claim 14, wherein the discharge duct of the first section is positioned at an end of the compressor.

16. The compressor according to claim 14, further comprising an inter-section wall at least partially defining the discharge duct of the second section and the inlet duct of the first section.

17. The compressor according to claim 16, wherein the discharge duct of the first section and the inlet duct of the second section are placed on opposite ends with respect to the inter-section wall.

18. The compressor according to claim 14, further comprising an interphase seal between the discharge duct of the second section and the inlet duct of the first section.

19. The compressor according to claim 14, further comprising a further seal between the discharge duct of the first section and an external environment; a first discharge scroll in fluid communication with the first discharge duct; wherein the further seal is arranged between the axis of rotation and the first discharge scroll.

* * * * *